United States Patent [19]

Gustafson et al.

[11] 4,247,274

[45] Jan. 27, 1981

[54] HOLDING DEVICE FOR SURFACE SHEETS OR PLATES IN A PRESS

[76] Inventors: Gunnar A. Gustafson, Musseronvägen 18, S-141 46 Huddinge; Ture R. L. Holmqvist, Dalkärrsleden 18, S-162 24 Vällingby, both of Sweden

[21] Appl. No.: 8,182

[22] Filed: Jan. 30, 1979

[30] Foreign Application Priority Data

Feb. 3, 1978 [SE] Sweden ..... 78012747

[51] Int. Cl.[2] ..... B30B 7/02; B30B 15/06

[52] U.S. Cl. ..... 425/193; 425/338; 425/405 R; 425/411; 425/DIG. 60; 425/DIG. 119

[58] Field of Search ..... 100/295, 297, 296, 194, 100/221, DIG. 18; 425/DIG. 60, DIG. 119, 338, 339, 405, 406, 411, 436, 469, 193; 156/580

[56] References Cited

U.S. PATENT DOCUMENTS 3,081,488 3/1963 Casavina et al. .

FOREIGN PATENT DOCUMENTS 829793 12/1951 Fed. Rep. of Germany .
152766 12/1955 Sweden .
328695 9/1970 Sweden ..... 425/338
523810 10/1976 U.S.S.R. ..... 100/DIG. 18

*Primary Examiner*—W. E. Hoag
*Attorney, Agent, or Firm*—Frishauf, Holtz, Goodman & Woodward

[57] ABSTRACT

A holding device for surface sheets or surface plates in a press intended, for example for pressing wood fiber products, include a press plate, a vacuum source for supplying vacuum to the side of a surface sheet or surface plate which faces toward the press plate, a vacuum distributing body placed between the press plate and the surface sheet, and a seal which is arranged to provide sealing between the present plate and the surface sheet. A substantially air-impervious sheet is disposed between the press plate and the surface sheet to form two essentially closed spaces coupled in air communication with the vacuum. This arrangement permits independent removal of the surface sheets from the press plates.

15 Claims, 4 Drawing Figures

HOLDING DEVICE FOR SURFACE SHEETS OR PLATES IN A PRESS

BACKGROUND OF THE INVENTION

This invention relates to a holding device for surface sheets or surface plates in a press intended for pressing wood fibre products, the said device comprising a press plate, a source for supplying vacuum to the side of a surface sheet or surface plate which faces towards the press plate, a vacuum-distributing body placed between the press plate and the surface sheet, and a seal which is arranged to afford sealing between the press plate and the surface sheet.

Devices for holding surface sheets in a press by means of vacuum are already known, one such device being shown in German patent specification No. 829,793. Shown in Swedish Pat. No. 328,695 is a further apparatus wherein a solid plate is used as a spacing member and a vacuum operates mainly around the surface plate in the vicinity of its edge.

In addition it has also long been known how to utilize for example a so-called compensation wire in order to compensate for sundry irregularities which can appear in a press. One example of such a wire is disclosed in Swedish Pat. No. 152,766.

Swedish patent application No. 7412003-1 discloses how the wire can be given an additional task apart from compensating for irregularities, namely it can also be used to reliably distribute the vacuum generated in order to hold the surface plate over its entire surface.

In applicants own earlier design according to the aforesaid Swedish patent application No. 7412003-1 and in other prior art mechanical designs to hold a surface plate and wire it was necessary to remove both the surface plate and the compensation wire in order to change the surface plate. In view of the fact that both compensation wires and surface plates have large dimensions and are thus both heavy and difficult to handle it would be a great advantage if the surface plate could be removed without it being necessary to remove anything else. The object of the present invention is therefore to provide such a device in which only the surface plate needs to be removed from the plate when changing the surface plate.

SUMMARY OF THE INVENTION

According to the present invention, the surface sheet or surface plate and the vacuum-distributing body are individually held by means of a vacuum. Particularly, the present invention is characterised in that disposed between the press plate and the surface sheet is an essentially air-tight sheet which is sealed against the seal so that two essentially closed spaces are formed to which the vacuum is supplied to directly or indirectly hold either (i) both the surface sheet and the seal and the essentially air-tight sheet and thus the body in position in relation to the press plate or (ii) only the essentially air-tight sheet and the seal and thus the body in relation to the press plate.

Particularly advantageous is an embodiment wherein between the surface sheet and the body is placed an essentially air-tight plate or sheet which is individually sealed against the press plate, the surface sheet being individually sealed against the press plate and the essentially air-tight plate or sheet being arranged to apply a sufficiently large vacuum to the surface sheet for this to be held in position by the vacuum, the last mentioned vacuum application nevertheless being interrupted when the surface sheet has been removed or being so adapted in relation to the capacity of the vacuum source that the essentially air-tight plate or sheet and the seal and thus the body are retained in position by the vacuum even when the surface sheet has been removed.

DETAILED DESCRIPTION

Figure 2:
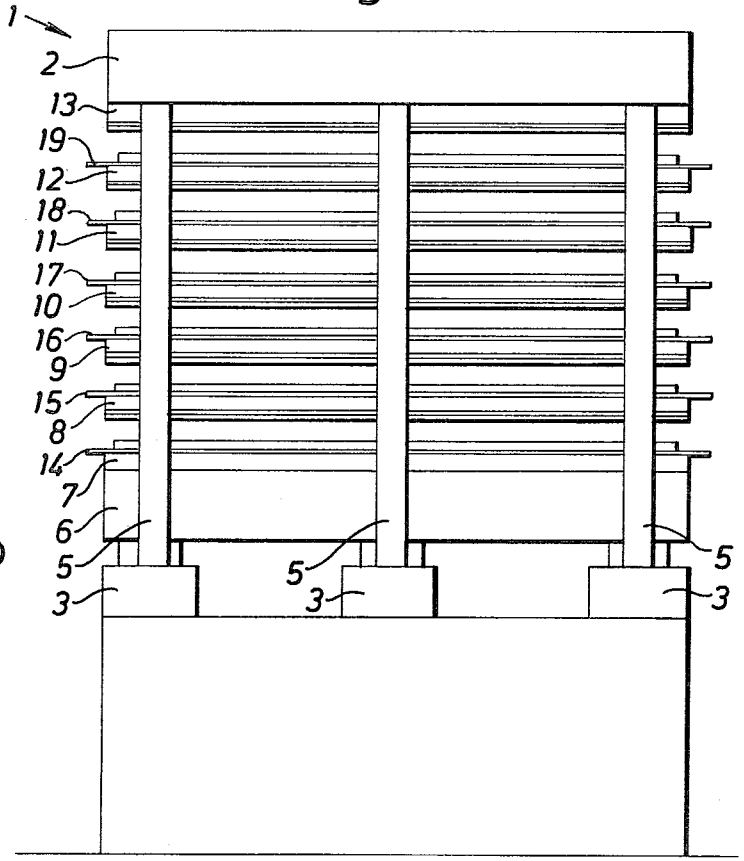
FIG. 2 shows a view of the press seen in a direction perpendicular to its feed direction.

A press 1 intended for forming fibreboard is shown in the direction of travel of the wood-fibre mats in FIG. 2 and comprises an upper stationary frame section 2, a lower stationary frame section 3 and several brace members 4, 5 which hold together the said frame sections 2, 3. The press further comprises one or more pistons 6, not shown in detail, which for example are movable from a lower position in the vicinity of the lower frame section 3 in the upward direction towards the upper frame section 2.

Between the upper and lower frame sections 2 and 3 is a space in which a plurality of press plates 7–13, heated for example by a steam flow, are located straight above each other, viewed in the vertical direction. Above each press plate 7–13 is located a plate or similar supporting device 14–19, not shown in detail, which plate has in a previous operation been provided with an unpressed fibreboard.

Figure 1:
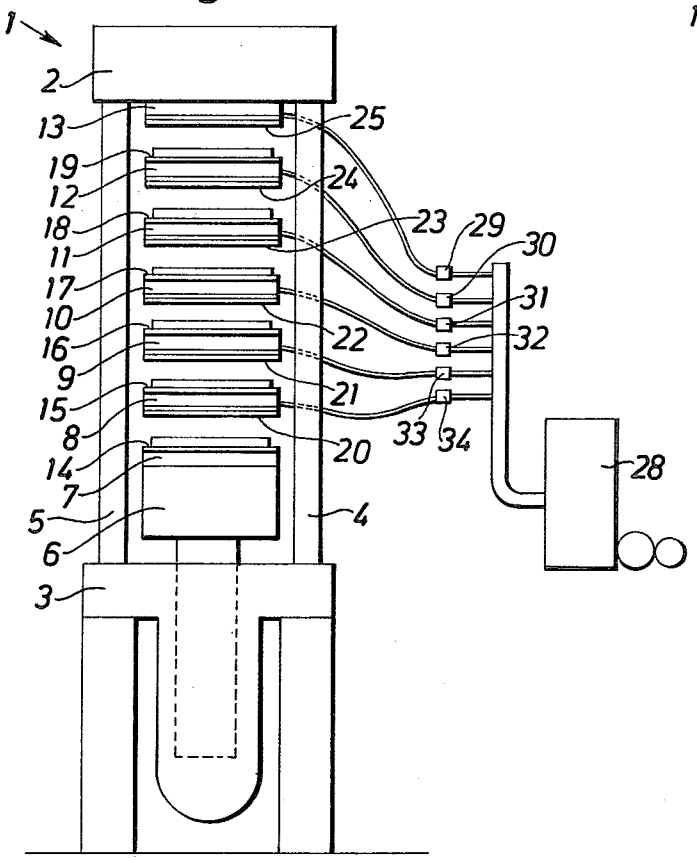
FIG. 1 shows a vertical view of a press seen in its feed direction.

In forming a fibreboard sheet from the respective wood-fibre mat the pistons 6 are activated to move upwards as seen in FIG. 1, whereby each mat is pressed between two press plates and heated by these press plates to a suitable temperature, the mat thereby being pressed into a fibreboard sheet while being subjected to pressure and heat.

Figure 3:
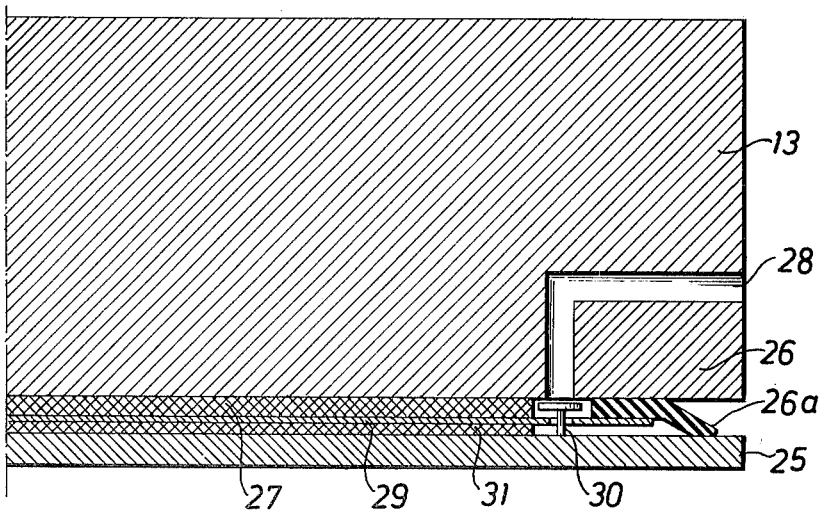
FIG. 3 shows a fundamental design of a press plate with accessories in accordance with the present invention and FIG. 4 shows a further embodiment of the device according to the present invention.

In order to provide each fibreboard sheet with suitable surface, the bottom side of each press plate 8–13 is provided with a surface sheet or surface plate 20–25, as particularly evident from the enlarged view in FIG. 3 of a portion of the upper press plate 13 with associated parts, the said FIG. 3 having been chosen as a first example of an embodiment of the present invention.

The surface plates or surface sheets are held against the press plates by means of a vacuum which is generated between the respective press plate 13 and surface plate 25. Disposed around the edges of each surface plate 25 is a sealing strip 26 of heat-resistant rubber, teflon, silicon or similar material and in the space between the heat-supplying press plate 13 and the surface-forming surface plate 25 can be inserted a woven metal network 27, a so-called compensation wire, or a similar, preferably porous body. The said sealing strip 26 is preferably provided with a downward directed lip 26a, against which the surface plate 25 seals. A further relatively thin air tight or air impervious holding plate or holding sheet 29 is inserted between the surface plate 25 and the press plate 13 and is provided with a number of holes in which valves 30, openable by bearing against the surface plate 25, can be placed.

When wishing to remove the surface plate 25, the lip 26a is lightened, (i.e. lifted up) whereby the surface plate 25 is released and can be removed. When the surface plate 25 is released it no longer opens the valves 30 and these then block the holes in which the valves 30 are placed. Consequently the wire (or metal network) 27 and the holding plate 29 and the seal 26 are still held in position in the press by the vacuum despite removal of the surface plate 25.

Instead of locating the valves 30 in the holes, the latter can be made relatively small and the vacuum unit given such a capacity that it is capable of retaining the holding plate 29 and the seal 26 in position despite the occurrence of a certain amount of leakage through the small holes to the surroundings.

Preferably an additional body 31 permitting passage of air is inserted between the holding plate 29 and the surface plate 25 but alternatively or as a complement the holding plate 29 can be so elaborated with a pattern on its lower side that the vacuum is distributed, for instance knurled.

Figure 4:
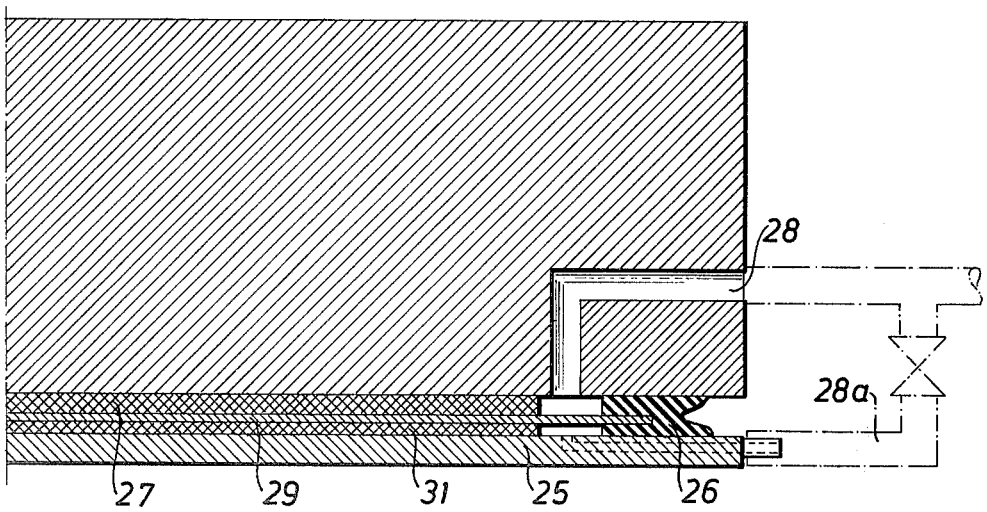

According to FIG. 3 all vacuum is supplied via the press plate 13 but according to FIG. 4 the vacuum can be supplied via two routes, namely partly via the press plate 13 and partly via the surface plate 25. In this latter case the surface plate 25 is provided with a suitable line for the vacuum and the seal 26 is given a somewhat different shape in comparison with the seal 26 according to FIG. 3. It is also feasible for all vacuum to be instead supplied via the seal 26.

We claim:

1. Holding device for surface sheets or surface plates in a press, comprising:

a press plate (13);

a surface sheet or plate (25) mounted to said press plate (13) with a surface facing toward said press plate (13);

means (28, 28a) for supplying vacuum to said surface of said surface sheet or plate (25) which faces towards said press plate (13);

an air-pervious vacuum-distributing body (27) mounted between said press plate (13) and said surface sheet or plate (25) and in air communication with said vacuum supplying means (28);

a seal (26) for providing air-tight sealing between said press plate (13) and said surface of said surface sheet or plate (25) which faces toward said press plate (13); and a substantially air-impervious sheet (29) disposed between said press plate (13) and said surface sheet or plate (25) and in air sealing communication with said seal (26) to form two essentially closed spaces coupled in air communication with said vacuum supplying means (28, 28*a*) to either (i) hold both said surface sheet or plate (25) and said seal (26) and said substantially air-impervious sheet (29) and thus said vacuum distributing body (27) in position in relation to said press plate (13), or (ii) hold only said substantially air-impervious sheet (29) and said seal (26) and thus said vacuum distributing body (27) in relation to said press plate (13).

2. The holding device of claim 1, wherein said seal comprises a first slotted portion for sealingly receiving said substantially air-impervious sheet (29), and seal portions which respectively seal against said surface sheet or plate (25) and said press plate (13).

3. The holding device of claim 1, wherein said substantially air-impervious sheet (29) comprises a plate.

4. The holding device of either of claims 1 or 3, wherein said air-impervious sheet (29) is provided with a number of valves (30) therein, said valves (30) being openable by said surface sheet or plate (25) to provide air communication between said two essentially closed spaces.

5. The holding device of claim 4, wherein said valves (30) include means for contacting said surface sheet or plate (29) to open said valves (30).

6. The holding device of claim 4, wherein said vacuum supplying means comprises a first vacuum line (28) running through said press plate (13) for supplying vacuum to at least one side of said substantially air-impervious sheet (29).

7. The holding device of claim 4, wherein said vacuum supplying means further comprises a second line (28*a*) for supplying vacuum to the side of said air-impervious sheet (29) which faces said surface sheet or plate (25).

8. The holding device of claim 7, wherein said second line (28*a*) runs in said surface sheet or plate (25) and opens on the surface thereof facing said substantially air-impervious sheet (29).

9. The holding device of any one of claim 1 or 3 wherein said substantially air-impervious sheet (29) includes means for applying a sufficiently large vacuum to said surface sheet or plate (25) to hold same in position by said vacuum applied thereto, and means for interrupting said last-mentioned vacuum application when said surface sheet or plate (25) is removed from said press plate (13).

10. The holding device of any one of claims 1 or 3 wherein said substantially air-impervious sheet (29) comprises a plurality of relatively small openings therein for transferring vacuum to the space between said substantially air-impervious sheet (29) and said surface sheet or plate (25), said holes being sufficiently small, and said supplied vacuum being sufficiently large, that said vacuum retains said substantially air-impervious sheet (29) and said seal (26) in position despite the leakage through said small openings.

11. The holding device of claim 1, wherein said seal comprises a lipped seal (26).

12. The holding device of claim 11, wherein said seal comprises a lip (26a) which seals against said surface sheet or plate (25) and a further sealing portion which seals against said substantially air-impervious sheet (29) and against said press plate (13).

13. The holding device of claim 1, wherein said vacuum supplying means comprises a first vacuum line (28) running through said press plate (13) for supplying vacuum to at least one side of said substantially air-impervious sheet (29).

14. The holding device of claim 13, wherein said vacuum supplying means further comprises a second line (28*a*) for supplying vacuum to the side of said air-impervious sheet (29) which faces said surface sheet or plate (25).

15. The holding device of claim 14, wherein said second line (28*a*) runs in said surface sheet or plate (25) and opens on the surface thereof facing said substantially air-impervious sheet (29).

* * * * *

UNITED STATES PATENT AND TRADEMARK OFFICE

CERTIFICATE OF CORRECTION

PATENT NO. : 4,247,274

DATED : January 27, 1981

INVENTOR(S) : Gunnar A. Gustafson et al.

It is certified that error appears in the above-identified patent and that said Letters Patent is hereby corrected as shown below:

Column 4, line 28 (claim 9, line 1), "claim 1 or 3" should read --claims 1, 3, 13, 14 or 15--;

Column 4, line 36 (claim 10, line 1), "claims 1 or 3" should read --claims 1, 3, 13, 14 or 15--.

Signed and Sealed this

*Sixteenth* Day of *November 1982*

[SEAL]

*Attest:*

GERALD J. MOSSINGHOFF

*Attesting Officer*

*Commissioner of Patents and Trademarks*